US005746143A

United States Patent [19]

Vatsky

[11] Patent Number: 5,746,143

[45] Date of Patent: May 5, 1998

[54] COMBUSTION SYSTEM FOR A COAL-FIRED FURNACE HAVING AN AIR NOZZLE FOR DISCHARGING AIR ALONG THE INNER SURFACE OF A FURNACE WALL

[76] Inventor: Joel Vatsky, 66 Lessing Rd., West Orange, N.J. 07052-2606

[21] Appl. No.: 595,900

[22] Filed: Feb. 6, 1996

[51] Int. Cl.[6] ..... F23L 1/00; F23L 9/00; F23L 13/00

[52] U.S. Cl. ..... 110/297; 110/260; 110/261; 110/263; 110/264; 110/265; 431/8; 431/174

[58] Field of Search ..... 110/104 B, 260, 110/261, 263, 264, 265, 347, 348; 431/8, 9, 10, 164, 165, 173, 174

[56] References Cited

U.S. PATENT DOCUMENTS

| | | | |
|---|---|---|---|
| 1,816,434 | 7/1931 | Kaemmerling | 431/173 |
| 2,206,553 | 7/1940 | Nagel | 431/10 |
| 2,216,117 | 10/1940 | Krug | 110/264 |
| 3,180,289 | 4/1965 | Steinert | 110/265 |
| 4,348,170 | 9/1982 | Vatsky et al. | 431/188 |
| 4,400,151 | 8/1983 | Vatsky | 431/184 |
| 4,425,855 | 1/1984 | Chadshay | 110/263 |
| 4,426,939 | 1/1984 | Winship | 110/347 |
| 4,471,703 | 9/1984 | Vatsky et al. | 110/263 |
| 4,570,551 | 2/1986 | Derbridge et al. | 110/263 |
| 4,672,900 | 6/1987 | Santalla et al. | 110/264 |
| 4,715,301 | 12/1987 | Bianca et al. | 110/347 |
| 4,810,186 | 3/1989 | Rennert et al. | 431/175 |
| 4,940,004 | 7/1990 | Jansen | 110/182.5 |
| 5,011,400 | 4/1991 | Vatsky | 431/4 |
| 5,020,454 | 6/1991 | Hellewell et al. | 110/264 |
| 5,146,858 | 9/1992 | Tokuda et al. | 110/261 |
| 5,199,357 | 4/1993 | Garcia-Mallol | 110/347 |
| 5,315,939 | 5/1994 | Rini et al. | 110/264 |
| 5,329,866 | 7/1994 | LaRue | 110/265 |
| 5,347,937 | 9/1994 | Vatsky | 110/261 |
| 5,441,000 | 8/1995 | Vatsky et al. | 110/265 |
| 5,461,990 | 10/1995 | Newman | 110/261 |
| B1 4,294,178 | 6/1992 | Borio et al. | 110/347 |

FOREIGN PATENT DOCUMENTS 883602 11/1981 U.S.S.R. .

*Primary Examiner*—Ira S. Lazarus
*Assistant Examiner*—Ljiljana V. Ciric
*Attorney, Agent, or Firm*—Haynes and Boone, L.L.P.

[57] ABSTRACT

A combustion system in which a coal/primary air mixture is discharged from burners located in the corners of the furnace towards an imaginary circle disposed in the center of the furnace. Air is discharged from air nozzles also located in the corners of the furnace in two flow streams—one directed towards the center of the furnace in a combustion-supporting relation to the fuel, and the other along the inner surfaces of the furnace boundary walls to maintain an oxidizing atmosphere and minimize corrosion and slagging.

7 Claims, 3 Drawing Sheets

Fig. 3
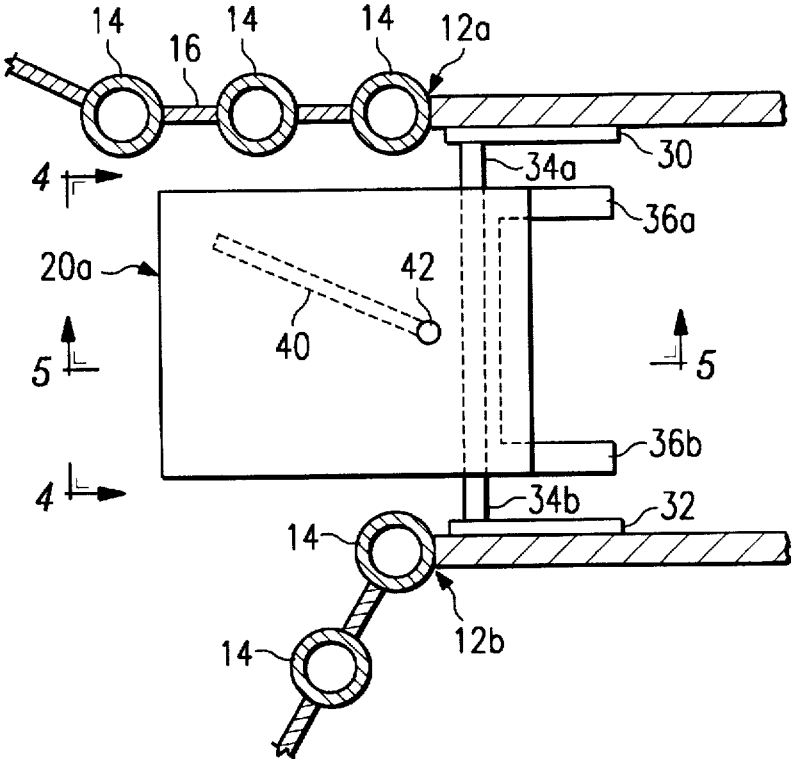
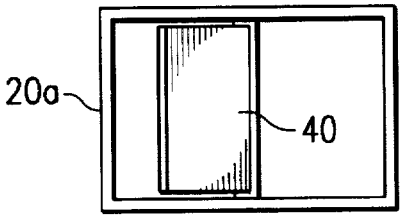
Fig. 4
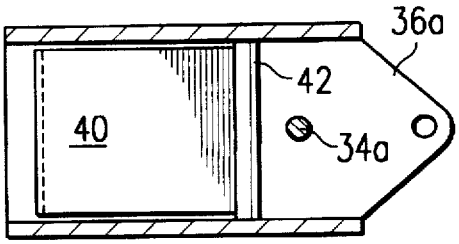
Fig. 5

COMBUSTION SYSTEM FOR A COAL-FIRED FURNACE HAVING AN AIR NOZZLE FOR DISCHARGING AIR ALONG THE INNER SURFACE OF A FURNACE WALL

BACKGROUND OF THE INVENTION

This invention relates generally to a combustion system and method utilizing a furnace in which a mixture of air and fuel, such as coal, is discharged from one or more burners in a tangential direction with respect to an imaginary circle in the center of the furnace and, more particularly, to such a system and method in which secondary air is also discharged into the interior of the furnace in a combustion-supporting relationship to the fuel.

In coal-fired combustion systems, a mixture of coal and primary air is usually discharged from one or more burners mounted relative to a furnace wall or walls, while secondary air is discharged from one or more air nozzles located adjacent each burner. Many types, arrangements and locations of the burners and the secondary air nozzles have been used. For example, in a conventional, straight-firing system, the burners and the secondary air nozzles are mounted relative to the furnace walls in a manner to respectively discharge the coal/primary air mixture and the secondary air in a direction perpendicular to the walls. In contrast, and in an effort to improve the combustion efficiency among other things, a tangential firing system has evolved in which the burners and the air nozzles are disposed in each of the corners of the furnace. In these tangential arrangements, the burners and secondary air nozzles are located and designed to respectively discharge the coal/primary air mixture and the secondary air in a direction generally tangentially to an imaginary circle in the center of the furnace. In some of these designs the burners discharge the coal/primary air mixture tangentially with respect to one circle, and the air nozzles discharge the secondary air with respect to another circle having a different diameter. The burners and the air nozzles are also often tiltable about a horizontal axis to enable their air discharge pattern to be varied in a vertical direction, i.e., along the height of the furnace which, among other things, enables the furnace temperature to be controlled.

However, since all of the secondary air is discharged towards the center of the furnace interior, a reducing atmosphere is often present along the inner surfaces of the boundary wall which causes corrosion and slagging.

Also, since these types of furnaces are usually asymmetrical in plan view, that is, two opposed furnace walls are relatively short and the other two opposed walls are relatively long, each air nozzle must be designed with a specific discharge pattern depending on the particular corner of the furnace in which it is mounted and the particular size of the imaginary circle to which its discharge pattern is directed. This, of course, adds to the cost of the system.

Therefore, what is needed is a tangentially fired combustion system and method in which corrosion and slagging along the inner surfaces of the furnace boundary walls are minimized.

SUMMARY OF THE INVENTION

The combustion system and method of the present invention overcomes the above problems by utilizing a unique secondary air discharge pattern in a tangential coal/primary air firing arrangement. More particularly, according to the system of the present invention, the coal/primary air mixture is discharged in a conventional pattern, that is, towards an imaginary circle disposed in the center of the furnace; while in a departure from the prior art, the secondary air is discharged in two patterns—one towards the center of the furnace, and another along the inner surfaces of the furnace boundary walls. To this end an air nozzle is provided in each corner of the furnace adjacent a burner and is provided with a damper blade that splits the air flow into two discharge flow patterns, with one being directed generally towards the center of the interior of the furnace in a combustion-supporting relationship to the fuel, and the other being directed towards the inner surface of an adjacent boundary wall to maintain an oxidizing atmosphere along the inner surfaces of the furnace wall. Thus, the combustion system and method of the present invention enjoys all of the advantages of a tangentially-fired system while eliminating corrosion and slagging along the inner furnace walls.

According to another feature of the present invention the air flow and discharge pattern from each air nozzle can be adjusted in accordance with particular nozzle location and design requirements.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein:

FIG. 3 is a cross-sectional view taken along the line 3—3 of FIG. 2; and FIGS. 4 and 5 are cross-sectional views taken along the lines 4—4 and 5—5, respectively, of FIG. 3.

DESCRIPTION OF THE PREFERRED EMBODIMENT

Figure 1:
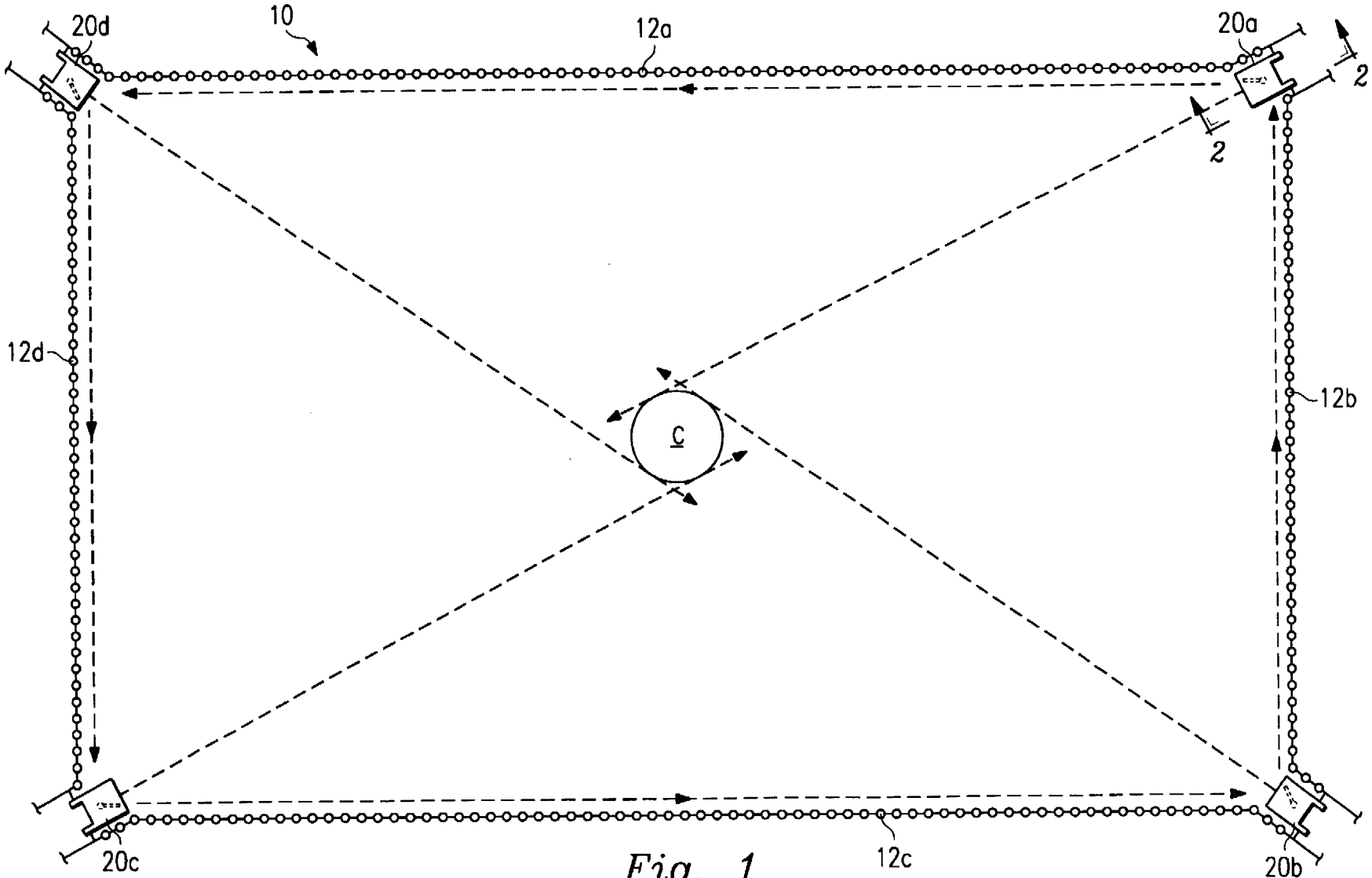
FIG. 1 is a partial plan-partial schematic view depicting the combustion system of the present invention.

Referring to FIG. 1 of the drawings, the combustion system of the present invention includes a furnace 10 formed by four interconnected, upright boundary walls 12*a*–12*d*. The opposed walls 12*a* and 12*c* are relatively long and the opposed walls 12*b* and 12*d* are relatively short to form a furnace having a rectangular cross-section. Each wall 12*a*–12*d* is formed by a plurality of vertically-extending water tubes 14 extending in a slightly-spaced relationship, with a plurality of continuous fins 16 extending from diametrically-opposed portions of the tubes to connect adjacent tubes and render the furnace gas-tight, all in a conventional manner.

Four air discharge nozzles 20*a*–20*d* are disposed in the respective corners of the furnace 10 and are mounted relative to the furnace walls 12*a*–12*d* in a manner to be described. The nozzles 20*a*–20*d* are constructed and arranged in a manner to be described to receive air from an external source and discharge it in two separate flow patterns. More particularly, and referring to the nozzle 20*a* as an example, the air from the latter nozzle is discharged in two flow patterns-one directed tangentially towards an imaginary circle C disposed in the center of the interior of the furnace 10 as shown by the dotted line, and the other directed along the inner surface of the wall 12*a*, as shown by the dashed line. It is understood that the nozzles 20*a*–20*d* respectively extend immediately above four burners (not shown in FIG. 1) each of which is constructed and arranged to also discharge an coal/primary air mixture tangentially to an imaginary circle (not shown) but at a different height in the furnace interior. The latter imaginary circle can have a different diameter, or the same diameter, as the circle C.

Figure 2:
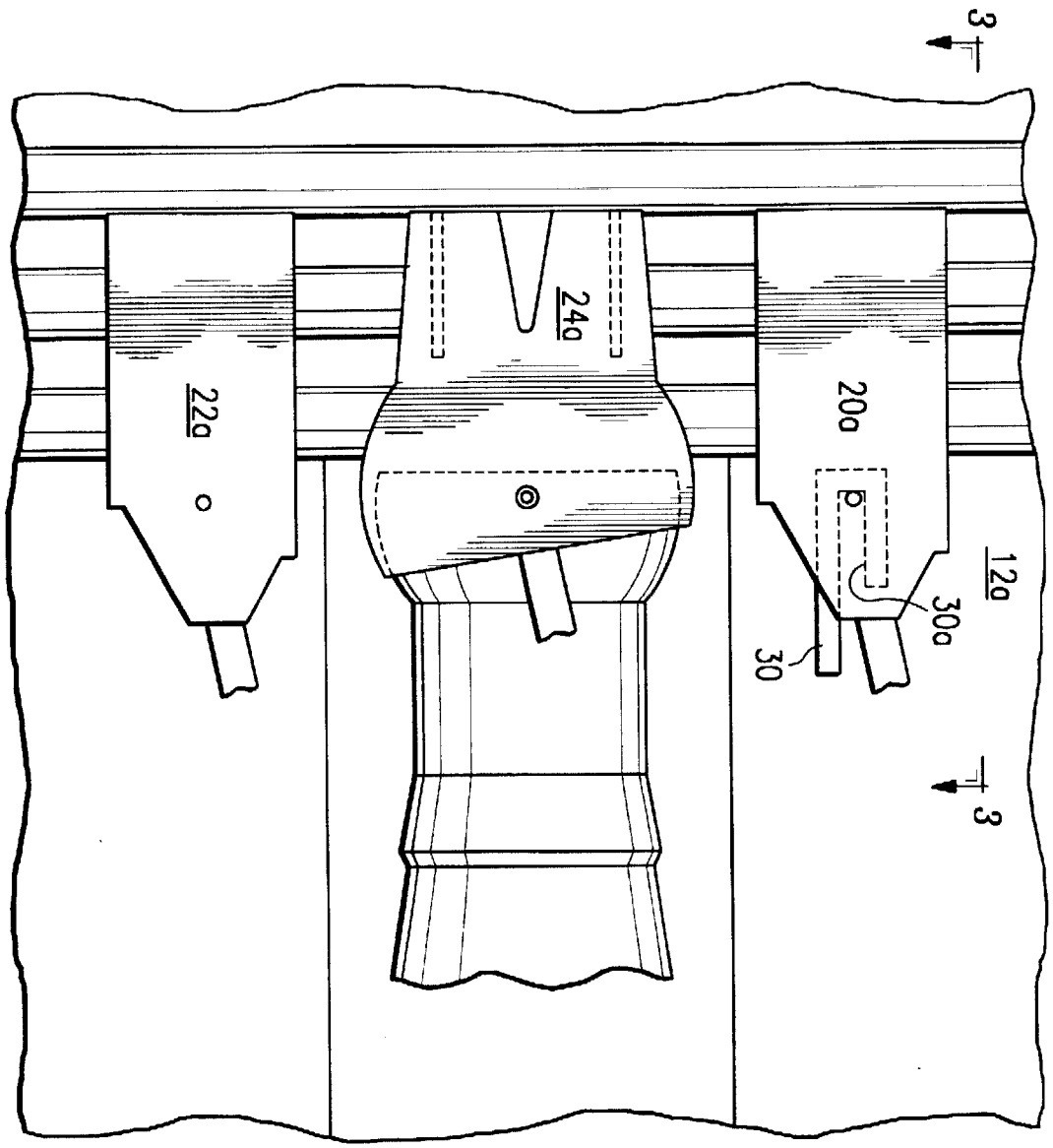
FIG. 2 is a cross-sectional view taken along the line 2—2 of FIG. 1.

The nozzle 20*a* extends in the corner between the walls 12*a* and 12*b* and is shown in detail in FIG. 2, along with another air discharge nozzle 22*a* which is identical to the nozzle 20*a*. The nozzle 20*a* extends immediately above a burner 24*a* and the nozzle 22*a* extends immediately below the burner 24*a*. The burner 24*a* is of a conventional design and, as such, is adapted to discharge a mixture of coal and primary air from an external source (not shown) into the interior of the furnace 10 in the flow pattern described above, i.e., tangentially to an imaginary circle located in the center of the furnace interior.

The nozzles 20*a* and 22*a* and the burner 24*a* are mounted between two portions of the walls 12*a* and 12*b*, which portions are bent from the planes of their respective walls into an opposed relation with each other. As noted from FIG. 2, the end portions of these bent portions of the walls 12*a* and 12*b* are of a standard construction, that is, they are not formed by the spaced, interconnected tubes 14. Since the nozzle 22*a* is identical to the nozzle 20*a*, only the latter will be described in detail.

A pair of U-shaped mounting plates 30 (FIGS. 2 and 3) and 32 (FIG. 3) are secured to the walls 12*a* and 12*b*, respectively, in any known manner for pivotally mounting the air nozzle 20*a* relative to the latter walls. To this end, an elongated, U-shaped slot 30*a* (FIG. 2) is provided in the plate 30, it being understood that a similar slot (not shown) is formed in the plate 32. As shown in FIG. 3, a pair of mounting shafts 34*a* and 34*b* project from the respective sidewalls of the housing of the nozzle 20*a* and into the slot 30*a* and the slot associated with the plate 32, respectively, to mount the nozzle 20*a* for pivotal and axial movement relative to the plates 30 and 32. (Alternatively, as shown by the dashed lines in FIG. 3, a single mounting shaft can extend through the housing with its respective end portions projecting from the housing and extending in the slot 30*a* and the slot associated with the plate 32.) This pivotal movement causes the discharge end portion of the nozzle 20*a*, that is, the end portion facing the interior of the furnace 10, to tilt upwardly and downwardly relative to the furnace walls 12*a* and 12*b*, as will be described.

A pair of lobes 36*a* and 36*b* (FIG. 3) are formed at the other end of the discharge nozzle 20*a*, which end functions as an inlet for receiving air from a windbox (not shown). The lobes 36*a* and 36*b* are for the purpose of connecting the nozzle 20*a* to a linkage and drive mechanism (not shown) for selectively pivoting the nozzle 20*a* in the above manner. This linkage and drive mechanism is fully disclosed in application Ser. No. 288,863 filed on Aug. 11, 1994, now U.S. Pat. No. 5,461,990, and assigned to the assignee of the present invention, the disclosure of which is incorporated by reference. Since this linkage and drive system does not, per se, form a part of the present invention it will not be discussed in detail.

As a result of the foregoing, the nozzle 20*a* can be selectively pivoted about the axis defined by the shafts 34*a* and 34*b* to vary the discharge angle of the air discharging from the discharge end portion of the nozzle 20*a*, in a plane extending perpendicular to the axes of the shafts. This allows the air discharge pattern to be varied along the height of the wall 12*b*.

As shown in FIGS. 2–5, a damper blade 40 is disposed in the housing of the nozzle 20*a* and is secured in any known manner to a shaft 42 which extends from the upper wall of the nozzle housing to the lower wall thereof. The shaft 42 is rotatably mounted relative to the latter walls in any known manner such as, for example, providing journals, bearings, or the like (not shown), in the walls that receive the respective end portions of the shaft 42. Thus, rotation of the shaft 42 causes corresponding pivotal movement of the damper blade 40 to enable the blade to be precisely located in a predetermined position in the housing, as will be explained.

The blade 40 functions to split the air flowing through the nozzle 20*a* into two flow streams—one directed towards the center of the furnace interior as shown by the dotted lines in FIG. 1, and the other directed towards the inner surface of the adjacent wall 12*a*. Pivotal movement of the blade 40 varies the quantity of air in each flow stream as well as the discharge angle pattern, with the latter variation being in a plane perpendicular to the plane in which the discharge angle varies as a result of the tilting of the nozzle, as described above. This control of the position of the blade 40 enables the quantity of air in, and the discharge patterns of, the respective flow streams to be precisely adjusted as will be described.

In operation, air from an external source is introduced into each of the air nozzles 20*a*–20*d* and the respective blade 40 of the each nozzle is pivoted to a predetermined position to split the air in each nozzle into flow streams. As shown in connection with the nozzle 20*a*, for example, in FIG. 1, one of the air streams discharging from the latter nozzle is directed towards the center of the interior of the furnace 10 tangentially to the imaginary circle C as shown by the dotted line, and the other is directed along the inner surface of its corresponding adjacent wall 12*a* as shown by the dashed line. The position of the blade 40 is adjusted to vary the relative quantities of air directed towards the circle C and along the wall 12*a* in accordance with particular design requirements, one of which is to insure that the air stream directed along the wall 12*a* is sufficient to insure that an oxidizing atmosphere is maintained along the latter wall.

It is understood that the nozzles 20*b*–20*d* are identical to the nozzle 20*a* and function to discharge a first stream of the air received thereby tangentially to the circle C, and a second stream of the air along the walls 12*b*–12*d*, respectively. In this context, since the walls 12*a* and 12*c* are longer than the walls 12*b* and 12*d* (FIG. 1), the damper blades 40 associated with the nozzles 20*a* and 20*c* will be in a slightly different position when compared to the position of the blades 40 associated with the nozzles 10*b* and 10*b* in order to insure that a sufficient quantity air from each nozzle 20*a*–20*d* is discharged along its respective adjacent wall 12*a*–12*d*.

The above-mentioned linkage and drive mechanism is then activated to cause a pivotal, or tilting, movement of the nozzle 20*a*, to vary the discharge pattern along the height of the wall 12*a*, it being understood that the discharge end of the burner 24*a* can also be tilted in the manner described in the above-identified patent application.

The mounting of the shafts 34 and 36 in the U-shaped slot 30*a* and the slot associated with the plate 32 accommodates any differential thermal expansion between the nozzle 20*a* and the walls 12*a* and 2*b* thus minimizing damage to the nozzles, the walls or any other associated structure.

It is also understood that the nozzle 22*a* is identical to, and functions in the same manner as, the nozzle 20*a*, and that a nozzle identical to the nozzle 22*a*, as well as a burner identical to the burner 24*a*, is associated with each of the nozzles 20*b*–20*d*.

The present invention enjoys the advantages of a tangentially fired system discussed above and, in addition, enables an oxidizing atmosphere to be maintained along the interior of the furnace walls 12*a*–12*d* which minimizes corrosion and slagging. Further, the control of the position of the blade 40 of each of the nozzles enables the discharge patterns of the air streams discharging therefrom to be precisely adjusted, while the tilting of the nozzle varies the air discharge pattern along the height of the wall.

Also, all of the above-mentioned air discharge nozzles can be identical and their respective dampers adjusted to vary their respective flow patterns depending on their location relative to the long walls 12*a* and 12*c* and the short walls 12*b* and 12*d* for the reasons described above. This eliminates the need for manufacturing separate nozzles for each particular location and thus reduces the cost of the system.

It is understood that several variations may be made in the foregoing without departing from the scope of the present invention. For example, the shaft 32 may be rigidly mounted in the housing of the nozzle 20*a* and the blade 40 pivotally mounted relative to the shaft. Also, the system and method of the present invention are not limited to use with a coal-fired furnace or burner, but rather can be used with other fuel and in other environments.

Other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A combustion system for a fuel-fired furnace having four walls, the system comprising at least one air nozzle comprising a housing for receiving air and discharging air into the interior of the furnace, means for mounting the housing to at least one furnace wall for pivotal movement about a horizontal axis to vary its air discharge pattern along the height of the furnace, a damper blade mounted in the housing about a vertical axis for splitting the air into two streams and directing one stream along the inner surface of a furnace wall and the other stream towards the center of the furnace; and a burner mounted to the at least one furnace wall in a vertically spaced relation to the air nozzle for discharging fuel into the furnace, the damper blade directing the other stream into a combustion-supporting relation with the fuel.

2. The system of claim 1 wherein pivotal movement the damper blade varies the quantity of air in each stream.

3. The system of claim 1 wherein the burner and the air nozzle are adapted to discharge the fuel and the other air stream, respectively, in a direction towards an imaginary circle disposed in the center of the furnace.

4. The system of claim 1 wherein the furnace walls form four corners and wherein at least one burner and at least one air nozzle are mounted in each corner and to the walls forming the corner.

5. The system of claim 4 wherein each air nozzle is adapted to discharge the air along a different furnace wall.

6. The system of claim 1 wherein the damper is pivotally mounted in the housing about the vertical axis to vary the flow of the streams.

7. The system of claim 1 wherein the means comprises a shaft extending between two of the walls at a corner of the furnace, the housing receiving the shaft for permitting the pivotal movement.

* * * * *

UNITED STATES PATENT AND TRADEMARK OFFICE

CERTIFICATE OF CORRECTION

PATENT NO. : 5,746,143

DATED : May 5, 1998

INVENTOR(s) : Joel Vatsky

It is certified that error appears in the above-identified patent and that said Letters Patent is hereby corrected as shown below:

On the title page item [54]

"Coal-Fired" should read-Fuel-Fired--

In the Claims:

Claim 1, line 2, "system comprising" should read –system comprising: at least one air nozzle, said air nozzle--

Signed and Sealed this

Eighth Day of June, 1999

*Attest:*

Q. TODD DICKINSON

*Attesting Officer*

*Acting Commissioner of Patents and Trademarks*